US005820412A

United States Patent [19]

Koegel et al.

[11] Patent Number: 5,820,412

[45] Date of Patent: Oct. 13, 1998

[54] CONNECTOR SHIELD WITH CABLE CRIMP SUPPORT

[75] Inventors: Keith Scott Koegel, Plainfield; George Richard Defibaugh, Mechanicsburg; Earl Chester Myers, Jr., Harrisburg, all of Pa.

[73] Assignee: The Whitaker Corporation, Wilmington, Del.

[21] Appl. No.: 820,269

[22] Filed: Mar. 18, 1997

[51] Int. Cl.[6] ..... H01R 9/03

[52] U.S. Cl. ..... 439/610

[58] Field of Search ..... 439/610, 98

[56] References Cited

U.S. PATENT DOCUMENTS

| | | | |
|---|---|---|---|
| 4,653,836 | 3/1987 | Peele | 439/610 |
| 4,916,804 | 4/1990 | Yoshimura et al. | 439/610 |
| 4,981,447 | 1/1991 | Ichitsubo | 439/607 |
| 5,158,481 | 10/1992 | Frantz | 439/607 |
| 5,409,400 | 4/1995 | Davis | 439/610 |
| 5,667,407 | 9/1997 | Frommer et al. | 439/610 |

FOREIGN PATENT DOCUMENTS

| | | | |
|---|---|---|---|
| 0501629 A1 | 9/1992 | European Pat. Off. | H01R 13/58 |
| 4-153855 | 1/1994 | Japan | H01R 13/58 |

OTHER PUBLICATIONS

*AMP Japan Application Specification 114–5166*, "Termination and Assembly of CHAMP 0.50 Series (II) Shield Case Connector, Standard Type"; seven pages; (1992); AMP (Japan) Ltd, Kawasaki, Japan.

*Primary Examiner*—Neil Abrams
*Assistant Examiner*—Barry M. L. Standig
*Attorney, Agent, or Firm*—Anton P. Ness

[57] ABSTRACT

Connector assembly (10) secured to cable (12) having a pair of shield members (34,36) around the connector housing (42). Lower shield (34) has a cable crimping portion (90) having a pair of upstanding side arms (94,96) that are to be crimped around the cable to ground the shielding braid (24) thereof. Upper shield (36) includes a crimp support section (104) extending rearwardly along and against the cable so that the side arms (94,96) are crimped over the crimp support section (104), whereby the upper shield is integrated into the crimped connection (102).

12 Claims, 5 Drawing Sheets

CONNECTOR SHIELD WITH CABLE CRIMP SUPPORT

FIELD OF THE INVENTION

This relates to the field of electrical connectors and more particularly to connectors for electrical cables.

BACKGROUND OF THE INVENTION

An electrical connector that is terminatable to an electrical cable commonly has a conductive shield therearound defined by a pair of shields around the housing that are crimped to and around a portion of the cable rearwardly of both the connector housing and the array of discrete conductors extending from the cable to terminals within the housing. One of the shield members may have a pair of upstanding side arms that are formed by a tool to clamp around the cable over and around an exposed portion of the shielding braid of the cable.

It is desired to integrate the other shield member mechanically and electrically into the crimped connection.

SUMMARY OF THE INVENTION

The present invention is utilized in an electrical connector including at least two shield members surrounding an electrical connector that is terminated to a cable, where a conductive member is to be crimped around the cable exiting the connector assembly. A crimp support section is provided on at least one shield member that is a tab adjacent the cable as the conductive member is crimped around the cable and the at least one crimp support section, thus integrating the crimp support section or sections into the crimped connection and expressly involving the second shield member therein. When the cable has a shielding braid to which the connector shield must be groundingly connected at the crimped connection, each shield is directly groundingly connected to the shielding braid and to the first shield member thereat, either by a crimp support section or by having an integral crimp section defining the conductive member Commonly the conductive member is an integral crimp section of one of the shield members comprising a pair of upstanding arms. The crimp support section of the other shield member is a tab extending from the shield member preferably arcuate in shape to conform to the outer surface of the cable and complement the shape of the crimped connection, thus facilitating the process of crimping thereover the conductive member.

An embodiment of the present invention will now be described by way of example with reference to the accompanying drawings

DETAILED DESCRIPTION

Figure 1:
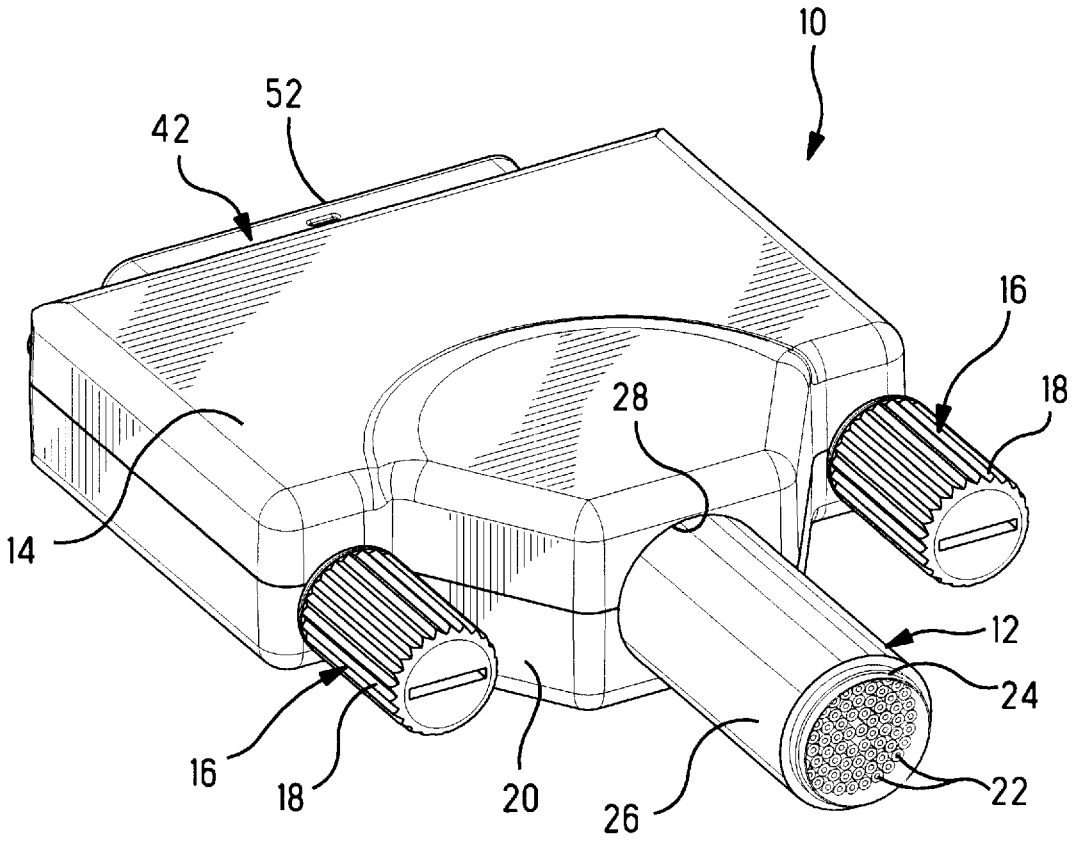
FIG. 1 is an isometric view of a connector terminated to an electrical cable.

Connector assembly 10 of FIG. 1 illustrates a connector terminated to cable 12 and having an insulative covering 14, through which extend a pair of jackscrews 16 to facilitate mating with a mating connector (not shown) upon actuation of actuation sections 18 extending rearwardly from rearward end 20 of assembly 10. Cable 12 is shown to have a plurality of discrete conductors 22 around which is first a conductive braid or shield 24 and then an insulative outer jacket 26 as it extends rearwardly from cable exit 28 of the assembly.

Figure 2:
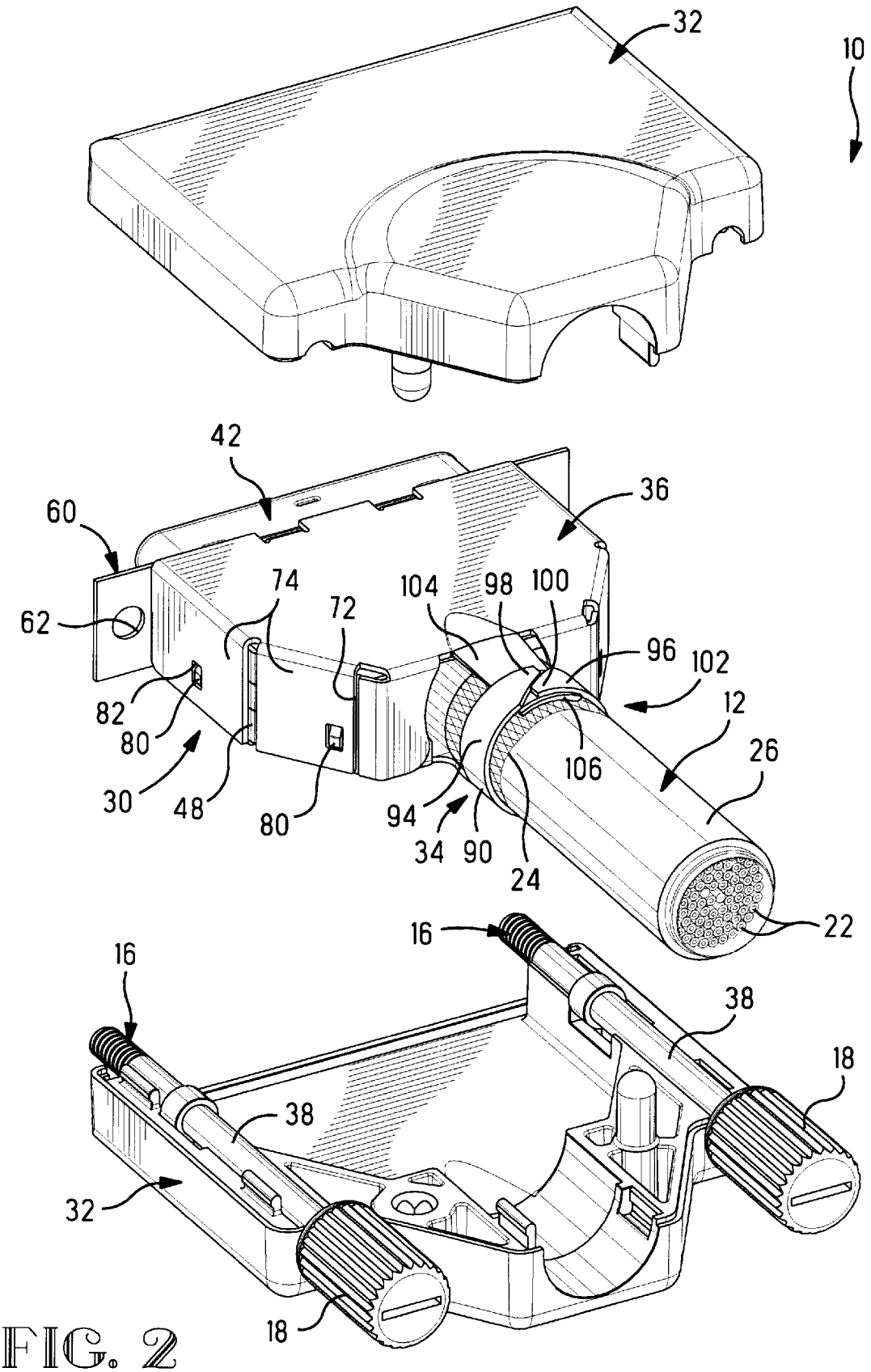
FIGS. 2 and 3 are isometric and longitudinal section views respectively of the assembly of FIG. 1 with the covers exploded from the connector assembly revealing the shielded connector terminated to the cable.
Figure 3:
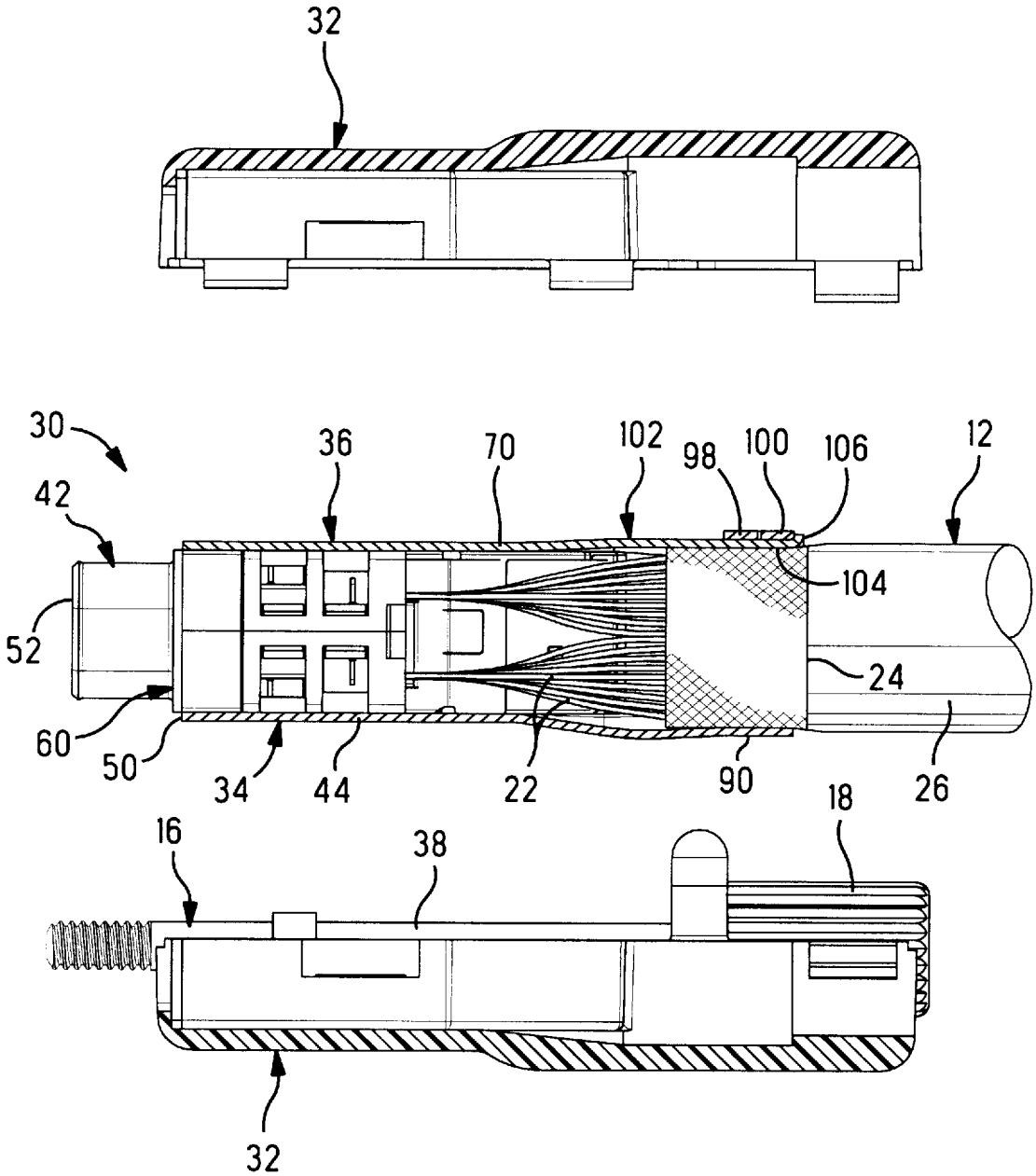

In FIGS. 2 and 3 is shown a shielded connector assembly 30 disposed between a pair of insulative cover members 32 that form the insulative covering 14. Shielded connector assembly 30 is surrounded by a conductive shield defined by a pair of shield members 34,36 that secure to each other and to an end portion of cable 12 by being crimped thereto around an exposed portion of shielding braid 22 to establish a ground connection therewith Cover members 32 self-secure to each other around the shielded connector assembly 30 and shafts 38 of jackscrews 16 and clamp to the outer jacket 26 of cable 12 rearwardly of the ground connection of the shield members 34,36 with the shielding braid 24, and are disclosed in greater particularity in U.S. patent application Ser. No. 08/820,218 16930) filed Mar. 18, 1997.

Figure 4:
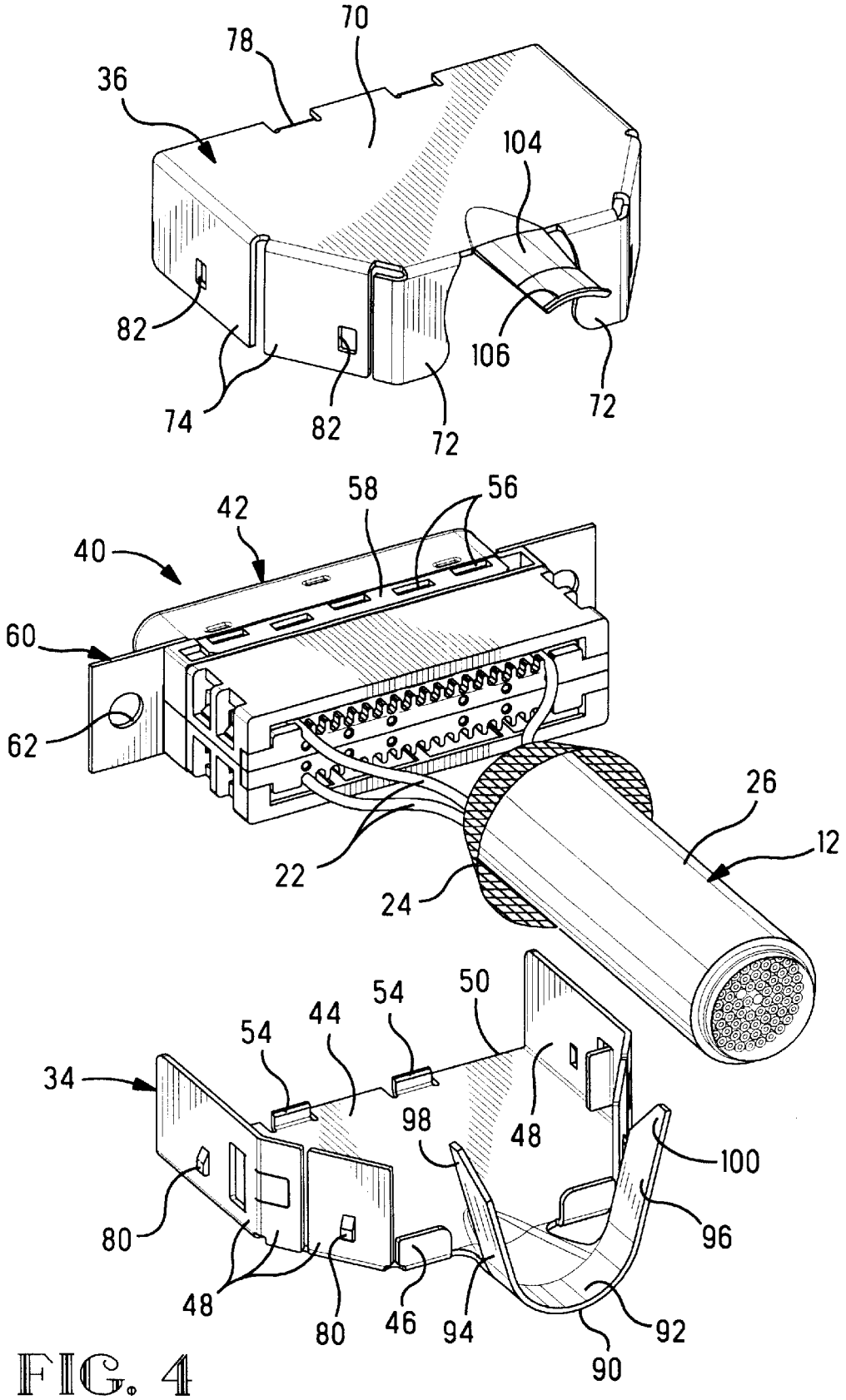
FIGS. 4 and 5 are isometric and longitudinal section views respectively of the shielded connector of FIGS. 2 and 3, with the shield members exploded from the connector assembly revealing the connector terminated to the cable.
Figure 5:
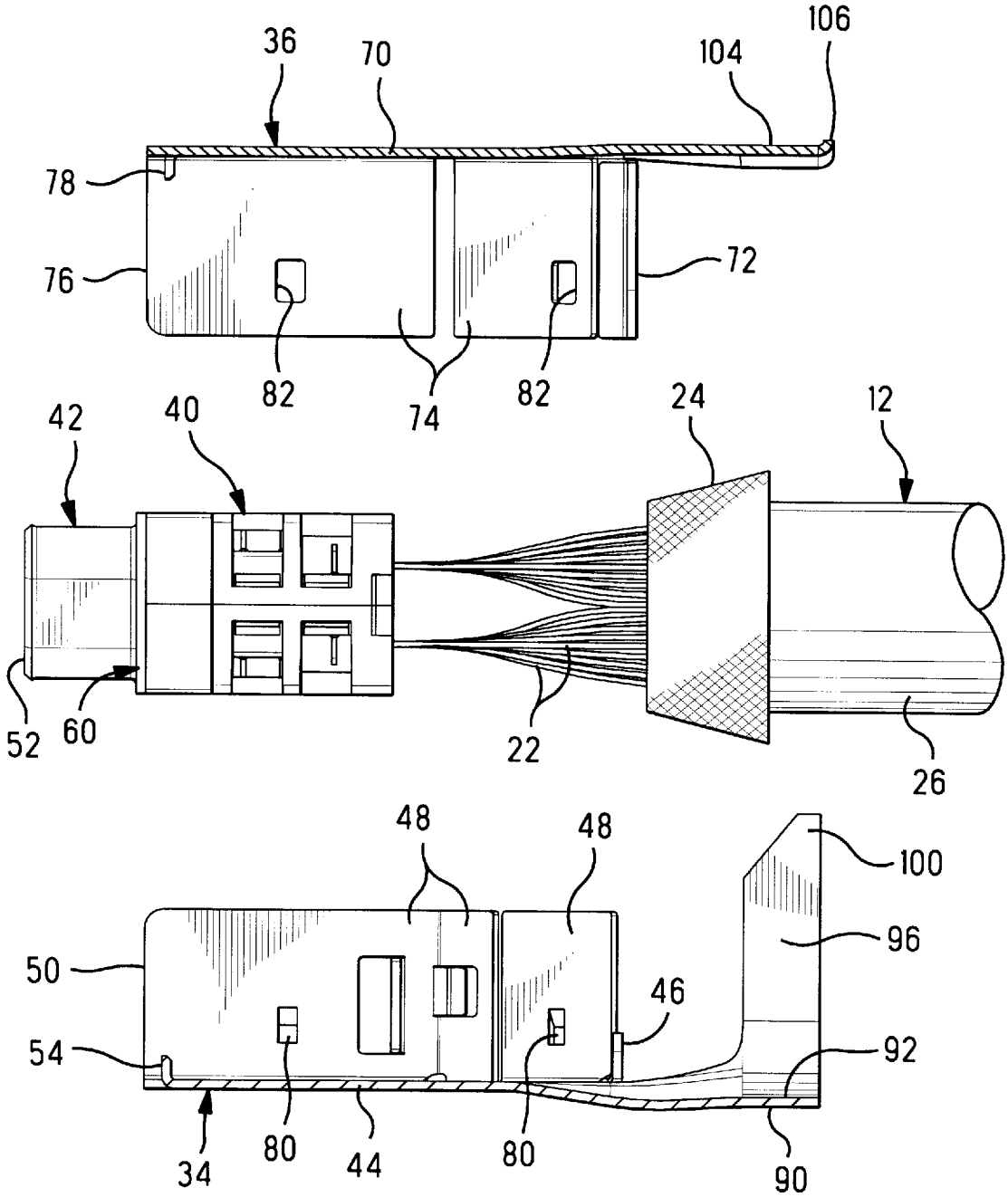

In FIGS. 4 and 5, shield members 34,36 are exploded from the connector/cable subassembly 40 defined by insulative connector housing 42 containing the terminals (not shown) terminated to the discrete conductors 22 of cable 12, a representative number of which are illustrated. First or lower shield member 34 is shown to have a generally planar body section 44 upwardly from rear edges of which extend rearward wall sections 46, and from side edges of which extend side walls 48 rearwardly of forward edge 50 that will be disposed adjacent mating face 52 of connector housing 42. Along forward edge 50 are short tabs 54 that will be received through corresponding slots 56 through a lower one of flanges 58 of shield plate 60 surrounding the forward end of connector housing 42; short tabs 54 will form a ground connection with shield plate 56 and will help secure the connector within the shield members; shield plate 60 contains apertures 62 whereof extend shafts 38 of jackscrews 16 upon assembly.

Second or upper shield member 36 also has a generally planar body section 70, rear walls 72 and side walls 74 extending to forward edge 76, with short tabs 78 also to cooperate with shield plate 60 at slots 56 of an upper one of flanges 58 thereof upon assembly in a manner similarly to short tabs 54 of lower shield member 34, to help secure the connector within the shield members and establish a ground connection with shield plate 60.

First or lower shield member 34 is seen to have several latching embossments 80 protruding outwardly from side walls 48, that are associated with recesses 82 of second or upper shield member 36 and will secure the upper and lower shield members to each other upon assembly when latching embossments 80 are seated within respective ones of recesses 82. It can be seen that the side walls and rear walls of upper and lower shield members 36,34 are formed with sections thereof having gaps between edges of the metal blanks from which the shield members are stamped, in a manner that sections of the side and rear walls of one shield member traverse and thus close over the gaps of the side and rear walls of the other, to define an effectively complete shield around connector/cable subassembly 40 rearwardly of shield plate 56

Lower shield member 34 is seen to include a cable crimping section 90 extending rearwardly from the center of body section 44, initially formed to conclude in a U-shaped channel 92 having upstanding elongate side arms 94,96. The free end portions 98,100 of side arms 94,96 are complementarily chamfered (FIG. 4) in opposed senses or directions with respect to the cable-receiving axis defined by the U-shaped channel, and the side arms are of such lengths, all such that together the side arms 94,96 more than surround the cable circumference after crimping as the chamfered free end portions 98,100 pass alongside each other after being crimped, with the crimped connection 102 thus formed seen in FIG. 2.

The cable crimp support of the present invention is provided by support section 104 extending rearwardly from the center of body section 70 of upper shield member 36. Support section 104 is preferably arcuate to conform to the cable's circumference at crimped connection 102 and is adapted to be positioned against the cable so that free end portions 98,100 of side arms 94,96 of cable crimping section 90 of lower shield member 34 overlie the support section so that the support section is crimped against the shielding braid 24 beneath free end portions 98,100 after crimping. Support section 104 preferably includes an upturned free end 106 that enhances the mechanical joint of the support section in the crimped connection, with the upturned free end extending outwardly from the cable rearwardly of the free end portions of side arms 94,96 after crimping. The upper shield member 36 is thus an integral portion of the crimped connection 102 both electrically and physically.

Variations and modifications may occur to the present invention. For example, the first shield member may have a single elongate side arm of sufficient length to be wrapped completely around the cable and over the crimp support section of the second shield member. In another embodiment, both shield members may have crimp support sections that together are placed within a separate crimping ferrule prior to crimping the ferrule to the cable.

What is claimed is:

1. A crimped connection of a connector shield to a cable, where first and second shield members are disposed around a connector and a crimped connection is defined by a conductive member surrounding the cable crimped to secure rearward sections of the shield members to the cable, further comprising:

at least one of said first and second shield members includes a crimp support section extending along and against the cable during assembly, said crimp support section extending rearwardly to a free end having an upturned edge portion to extend outwardly from said cable, and said conductive member is dimensioned to substantially completely surround said cable and each said crimp support section upon crimping to form a crimped connection to said cable and to be joined at least after crimping to each said shield member, whereby said upturned edge portion extends outwardly from said cable rearwardly of said crimped connection.

2. The crimped connection as set forth in claim 1 wherein each said crimp support section is arcuate to conform to the outer surface of said cable and extend partially around the circumference at said crimped connection.

3. The crimped connection as set forth in claim 1 wherein said conductive member forms an integral portion of said first shield member and includes a U-shaped channel having elongate side arms to be crimped around said cable after said cable is placed along said U-shaped channel, and only said second shield member is provided with a respective said crimp support section.

4. The crimped connection as set forth in claim 3 wherein said elongate side arms have free end portions that are chamfered in opposing directions with respect to the channel's cable-receiving axis such that said free end portions pass alongside each other after crimping.

5. A crimped connection of a connector shield to a cable, where first and second shield members are disposed around a connector and a crimped connection surrounds the cable to secure rearward sections of the shield members to the cable, comprising:

said rearward section of said first shield member defines a U-shaped channel with a cable-receiving axis and includes elongate side arms extending integrally therefrom orthogonal to said channel and have lengths together sufficient to extend around said cable upon crimping;

said rearward section of said second shield member includes a crimp support section extending rearwardly therefrom parallel to said cable exit; and end portions of said elongate side arms pass alongside each other upon crimping such that each said elongate side arm is crimped against said crimp support section, whereby upon crimping said elongate side arms around said cable and said crimp support section, each said shield member is integrally joined to the crimped connection.

6. A crimped connection as set forth in claim 5 wherein said free end portions of said elongate side arms are chamfered in opposing directions with respect to said channel's cable-receiving axis.

7. A crimped connection as set forth in claim 5 wherein said crimped support section includes an upturned edge portion at a free end to extend outwardly from said cable.

8. A crimped connection as set forth in claim 7 wherein said crimped support section is arcuate to conform to an outer surface of said cable and extend partially around said cable outer surface at said crimped connection.

9. Shield members for a connector, comprising:

first and second shield members to be disposed around said connector and including rearward sections defining a cable exit for a cable terminated by said connector;

said rearward section of said first shield member defines a U-shaped channel with a cable-receiving axis and includes elongate side arms extending integrally therefrom orthogonal to said channel and have lengths together sufficient to extend around said cable upon crimping;

said rearward section of said second shield member includes a crimp support section extending rearwardly therefrom parallel to said cable exit; and end portions of said elongate side arms pass alongside each other upon crimping such that each said elongate side arm is crimped against said crimp support section, whereby upon crimping said elongate side arms around said cable and said crimp support section, each said shield member is integrally joined to the crimped connection.

10. A crimped connection as set forth in claim 9 wherein said free end portions of said elongate side arms are chamfered in opposing directions with respect to said channel's cable-receiving axis such that said free end portions pass alongside each other after crimping.

11. A crimped connection as set forth in claim 9 wherein said crimped support section includes an upturned edge portion at a free end to extend outwardly from said cable.

12. A crimped connection as set forth in claim 11 wherein said crimped support section is arcuate to conform to an outer surface of said cable and extend partially around said cable outer surface at said crimped connection.

* * * * *